US005564202A

United States Patent [19]

Hoppenstein

[11] Patent Number: 5,564,202

[45] Date of Patent: Oct. 15, 1996

[54] HYDROPNEUMATIC SUPPORT SYSTEM FOR FOOTWEAR

[76] Inventor: Reuben Hoppenstein, 305 Second Ave., New York, N.Y. 10003

[21] Appl. No.: 353,952

[22] Filed: Dec. 12, 1994

Related U.S. Application Data

[63] Continuation of Ser. No. 175,942, Dec. 30, 1993, abandoned, which is a continuation of Ser. No. 998,541, Dec. 30, 1992, abandoned, which is a continuation-in-part of Ser. No. 762,062, Sep. 17, 1991, abandoned, which is a continuation of Ser. No. 528,055, May 24, 1990, abandoned.

[51] Int. Cl.[6] ..... A43B 13/18; A43B 13/20

[52] U.S. Cl. ..... 36/25 R; 36/28; 36/29; 36/71; 36/35 B

[58] Field of Search ..... 36/28, 29, 71, 36/35 R, 35 B, 25 R, 88, 91–95, 102, 103, 27, 31, 37, 43, 44, 153, 154, 141

[56] References Cited

U.S. PATENT DOCUMENTS

| | | | |
|---|---|---|---|
| 2,710,460 | 6/1955 | Stasinos | 36/28 |
| 2,721,400 | 10/1955 | Israel | 36/28 |
| 4,227,320 | 10/1980 | Borgeas | 36/29 |
| 4,391,048 | 7/1983 | Lutz | 36/28 |
| 4,680,875 | 7/1987 | Danieli | 36/28 |
| 4,768,295 | 9/1988 | Ito | 36/28 |
| 4,843,735 | 7/1989 | Nakanishi | 36/29 |
| 4,864,737 | 9/1989 | Marrello | 36/28 |
| 4,873,774 | 10/1989 | Lafever | 36/134 |
| 4,887,367 | 12/1989 | Mackness et al. | 36/35 B |
| 4,918,838 | 4/1990 | Chang | 36/28 |
| 4,934,072 | 6/1990 | Fredericksen et al. | 36/29 |
| 4,953,861 | 9/1990 | Nakanishi | 273/75 |
| 4,970,807 | 11/1990 | Anderié et al. | 36/35 R |
| 5,010,662 | 5/1991 | Dabuzhsky et al. | 36/30 R |

FOREIGN PATENT DOCUMENTS

| | | | |
|---|---|---|---|
| 1603646 | 11/1981 | United Kingdom | 36/29 |

*Primary Examiner*—Paul T. Sewell
*Assistant Examiner*—Marie Denise Patterson
*Attorney, Agent, or Firm*—Kalow, Springut & Bressler

[57] ABSTRACT

A sole and viscoelastic sole insert for footwear having an insert filled with an alternating configuration of gel and gas filled cells is provided. The impact response can be varied by altering the ratio of gas-filled to gel-filled cells or by altering the pressure under which the cells and/or pellets are filled with gas or gel. In similar fashion, an insert incorporating one or more springs may provide a number of impact responses by varying the number of springs and/or the spring design parameters. Advantageously, the inserts can be adapted to be readily removable from the sole so that the wearer can change the insert to provide a "universal" shoe ideally suited for a variety of applications and wearer preferences.

1 Claim, 5 Drawing Sheets

HYDROPNEUMATIC SUPPORT SYSTEM FOR FOOTWEAR

This application is a continuation of U.S. patent application, Ser. No. 08/175,942, filed Dec. 30, 1993, now abandoned which in turn in a continuation of U.S. patent application, Ser. No. 07/998,54, filed Dec. 30, 1992 now abandoned; which is a continuation-in-part of U.S. patent application, Ser. No. 07/762,062, filed Sep. 17, 1991, now abandoned; which is a continuation of U.S. patent application, Ser. No. 07/528,055, filed May 24, 1990 now abandoned.

BACKGROUND OF THE INVENTION

The present invention relates to footwear and, more particularly, to footwear wherein one or more viscoelastic inserts are disposed in the sole.

A shoe can be viewed as being divided into two general parts—an upper and a sole. The upper is designed to enclose the foot in a snug but comfortable manner. The sole is fashioned to provide a durable wear surface, provide traction, protection and shock absorption for the foot and leg while typically retaining a degree of flexibility.

Shoe design is a highly-refined science which results in the combination of upper and sole that work together to support and protect the foot while fulfilling a variety of specific criteria. Athletic shoes, for example, vary in design depending upon the sport in which the shoes are worn. Tennis shoes, basketball shoes, baseball shoes, running shoes, racquetball shoes and weightlifting shoes are each designed to be used in very specific and diverse ways. The design is crafted to provide a particular combination of support, traction, protection, shock absorption and flexibility to enhance performance. In addition to being designed for a specific function (sports, dress, casual wear, etc.), shoes are designed to meet specific wearer characteristics. For example, shoes for heavier persons are designed differently than shoes for lighter persons, differently for wide feet than for narrow feet, differently for high arches than for low arches, etc.

The midsole structure (i.e., the structure of the sole interior) must be designed to absorb the force of impact. Shock absorption relates to the attenuation of impact forces that can be harmful to the foot and other body parts. Energy absorption, on the other hand, pertains to the general soaking up of both impact and useful propulsive forces. A midsole may utilize one or more materials or components to absorb these two factors to varying degrees. The "trick" to shoe design is to properly balance shock absorption and energy absorption.

A midsole with "high" energy absorbing characteristics has relatively "low" resiliency and generally does not return much of the energy placed into the midsole at the point of foot impact, resulting in a "flat" feel and less efficient foot motion. By contrast, a midsole with "low" energy absorption has relatively "high" resiliency and returns more of the energy imparted to the midsole at the point of impact.

The terms "energy absorption" and "shock absorption" have often been used without precise delineation. While both effects pertain to independent actions of the midsole's response to the force of impact, the term "impact response" describes the operation of a midsole to both effects and the term "viscoelastic" describes the accomplishment of these two effects by a midsole. A desirable midsole, therefore, is one in which impact response contains the appropriate balance of shock absorption and energy absorption.

Attempts have been made to design an appropriate impact response by using a sole or an insert for the sole which contain a fluid medium such as a liquid or a gas. While initial designs of this type were plagued with development problems such as in providing adequate support and comfort, later designs such as those disclosed in U.S. patents to Rudy, Nos. 4,183,156 and 4,219,945 overcame the unreliability problem through the use of a membrane and gas combination. A later patent to Parker, et al., No. 4,817,304 improved the Rudy structure.

U.S. Pat. No. 4,843,735, issued Jul. 4, 1989 to Nakanishi describes a system similar to that used in the subject invention, but for the exclusive purpose of "shock absorption." Alternating air filled cavities and gel filled cavities form a shock absorbing sole. Sealed gel filled cavities retain the gel, whereas unsealed air filled cavities (merely covered) provide room for the gel-filled cavities to laterally expand. Since the air filled cavities are not sealed, they do not generate the upward force provided by the subject invention. Moreover, to achieve such a high level of shock absorption, Nakanishi must employ a very stiff gel (penetration value of from 50 to 200). (Penetration values throughout the subject application are expressed in millimeters divided by 10 (mm÷10)). In contrast, the subject application typically uses gels having a penetration value of greater than about 250. The penetration value is measured according to—JIS (Japan Industrial Standard)K2530-1976 (50 g load).

The use of sole inserts is known (see for example U.S. Pat. No. 4,680,875, issued Jul. 21, 1987 to Danieli). However, no sole insert has previously been designed to control energy absorption in the manner described by the subject invention.

While the prior art structures have greatly improved the sole's impact response, wearer comfort and impact response may be less than that desired because the sole fails to evenly distribute shock and pressure. Accordingly, the quest for an optimum sole structure which would meet the needs of virtually any shoe wearer in a variety of shoe applications is still being sought.

SUMMARY OF THE INVENTION

The present invention relates to footwear having one or more sole inserts that can constantly redistribute the pressures and shock imparted to the foot at the point of impact, even those attributed to the smallest foot movement. In addition, each sole insert improves wearer comfort, even for those wearers who do a lot of standing.

The subject invention is an article of footwear which comprises a sole having at least one cavity formed therein and at least one sole insert. Each sole insert is disposed within a cavity formed in the sole and includes at least one sealed first cell and at least one sealed second cell. The first and second cells are arranged in a side-by-side adjacent relationship to each other and cooperate with each other. Each first cell is filled with a gel material having a penetration value greater than about 250 and each second cell is filled with a gas, whereby a downward force on a first cell provides a lifting force from a second cell.

In general, each sole insert comprises a plurality of first and second cells which are separated by a plurality of intersecting members attached to a support structure defining the perimeter of the sole insert. The number of first cells may equal or differ from the number of second cells. The first cells may be filled with a gel material to establish a first pressure therein and the second cells may be filled with a gas to establish a second pressure therein. The first and second pressures may be selected from associated pressure ranges that can be independently varied.

For most purposes the sole insert has means for locking itself in position within the sole cavity. For the sake of versatility, the locking means are normally unlockable so that the sole insert can be removed after being locked into the sole cavity. Typical locking means include first and second protuberances which extend outwardly from the sole insert. These protuberances can engage first and second recesses which extend outwardly from a sole cavity. The cavity may open to the interior or exterior of the article.

The first and second cells may also be formed as pellets which can be placed in a side-by-side adjacent relationship within the sole cavity. Each pellet may be pressurized to a predetermined pressure selected from a preselected pressure range that can be independently varied for both the gel-filled pellets and the gas-filled pellets.

A method of manufacturing an article of footwear is also provided. This includes providing a sole having a cavity formed therein and placing an insert within the cavity. The insert usually has at least one first cell which is filled with a gel material having a penetration value greater than about 250 and at least one second cell which is filled with a gas and the first and second cells are alternately arranged in a side-by-side adjacent relationship and cooperate with each other so that a downward force on a first cell provides a lifting force from a second cell.

DETAILED DESCRIPTION OF THE DISCLOSURE

Figure 1:
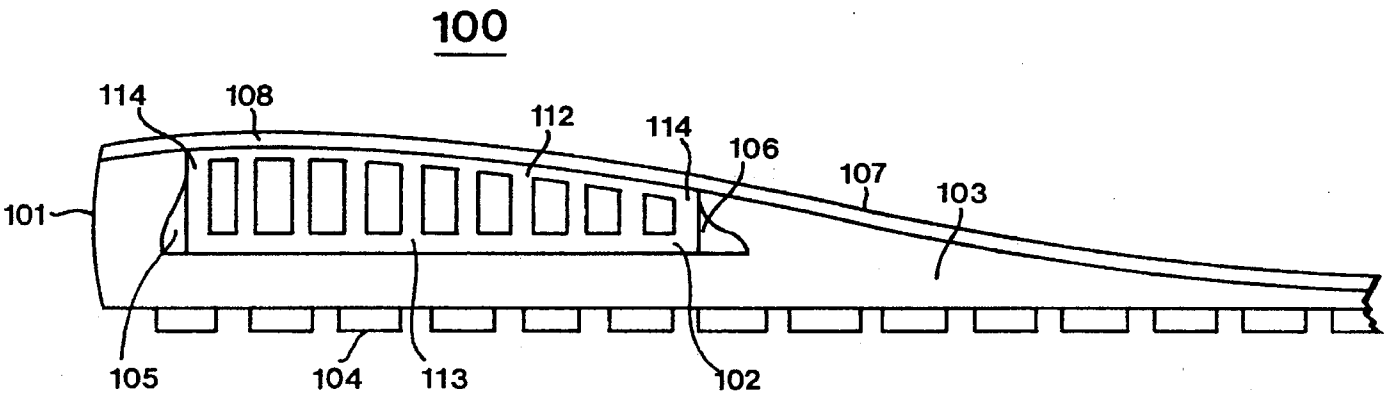
FIGS. 1 and 2, respectively, are an elevation and bottom view of shoe sole and insert pursuant to a first embodiment of the present invention.
Figure 2:
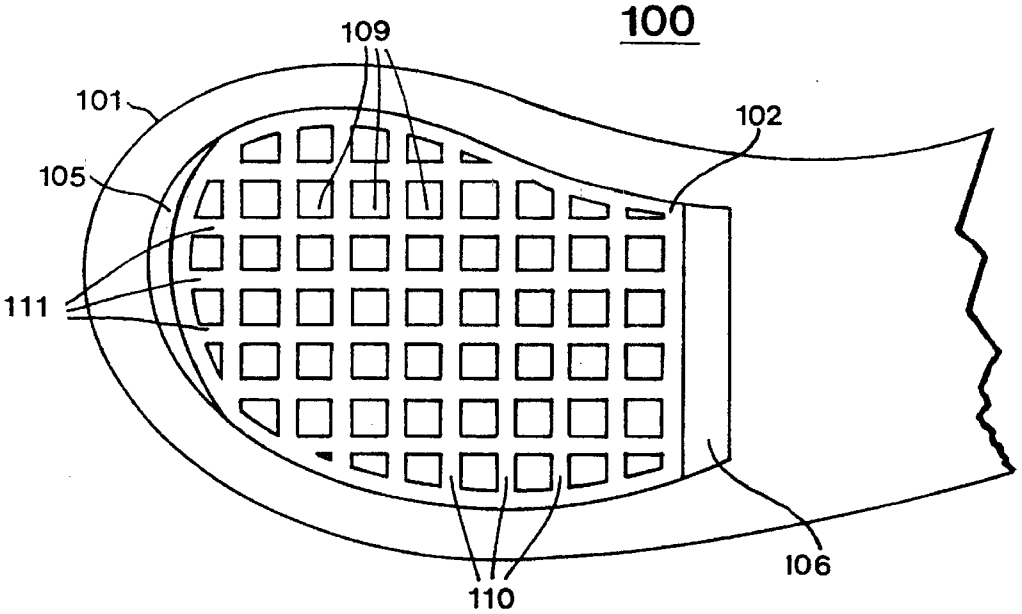

The combination 100 of a sole 101 and sole insert 102 in accordance with a first embodiment of the present invention is shown in FIGS. 1 and 2 (like numerals indicate like elements throughout the application and drawings). Combination 100 may be incorporated into any article of footwear (upper portion not shown). The sole 101 includes a force absorbing midsole 103 and a flexible, wear-resistant outsole 104. The midsole and outsole may be formed as a single integral unit. Midsole 103 incorporates a cavity into which insert 102 may be disposed.

Insert 102 advantageously incorporates forward and rear protuberances, respectively designated 105 and 106, which engage with mating recesses in the sole cavity to retain the insert in the sole. To place the insert within the sole cavity, the sole is flexed so that upper sole surface 107 is convex. The forward and rear protuberances are then sequentially engaged with their respective recesses in the sole cavity. When the upper surface of the sole returns to its normal shape (shown in FIG. 1), the insert is firmly secured in the sole cavity and the inner liner 108 of the shoe is replaced. This mating sole and insert structure advantageously permits the insert to be removed and reinserted by the shoe wearer, as desired.

Insert 102 includes a plurality of cells 109 formed by the intersection of ribs 110 and 111. These cells are filled, in alternation, with a gel material and a nondiffusible gas. The term nondiffusible refers to the fact that the gas cannot diffuse through the exterior surface of the insert (i.e. it substantially retains its pressure). The choice of gel material and gas is readily determinable by one skilled in the art. However, the gel will typically be a silicone gel (e.g., the Q7-2150/Q7-2146 gel system manufactured by Dow Corning) having a penetration value greater than about 250 ranging upward to 350 or higher, and the gas will be pressurized air or nitrogen.

When sealed by the upper 112, lower 113 and side surfaces 114 of the insert, each cell functions as an independent unit. The lower and side surfaces of the insert are preferably fabricated to be thicker than the upper surface so that the upper surface can expand upwardly against the wearer's foot. The gel-filled cells can be filled prior to the sealing of the upper surface or can be filled by penetrating fine needles into the associated cells and then injecting the gel material after the insert is completely sealed. The gas-filled cells can be filled with various pressures using the same technique or by sealing the insert in a gas-filled environment wherein the pressures of the gas can be modified.

By varying the pressures of the gas-filled cells, the sole and insert can be designed with high, medium or low pressures which, in turn, vary the impact response to suit the shoe application or wearer preference. Alternatively, the ratio of gas to gel-filled cells can be varied to provide a similar variation in impact response. In addition, the shoe can be sold with one pair of inserts and the purchaser can then buy additional inserts of varying pressures which have different impact responses for different activities. For example, cells filled under high pressure may be desirable for basketball, moderate pressure may be desirable for jogging and low pressure may be desirable for tennis, etc. Accordingly, the shoe can be readily varied to meet numerous activities and suit the preferences of the wearer.

Figure 4:
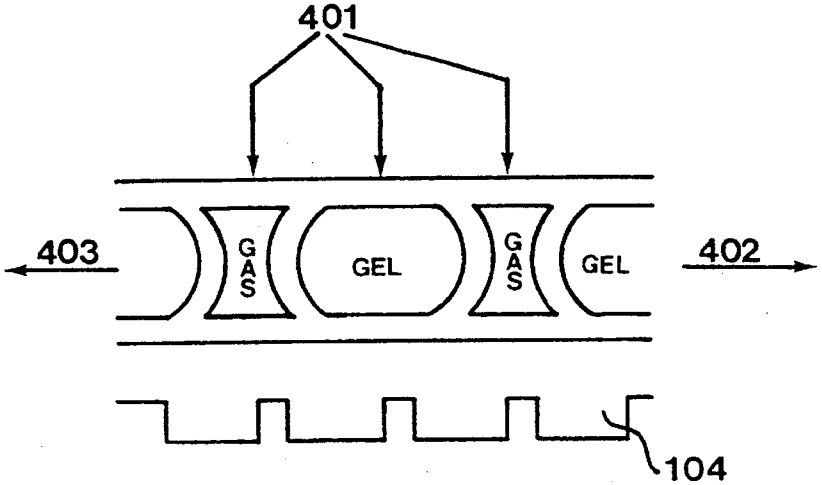
FIGS. 3 through 5 are elevation views of an arbitrary portion of the sole and sole insert of FIGS. 1 and 2 which depicts the impact response of the sole insert prior to and during use.
Figure 3:
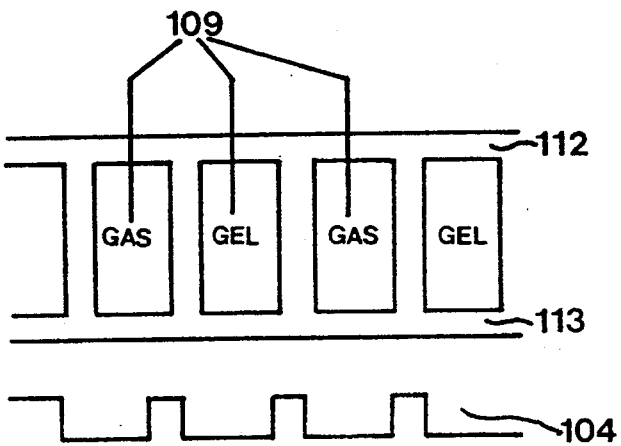
Figure 5:
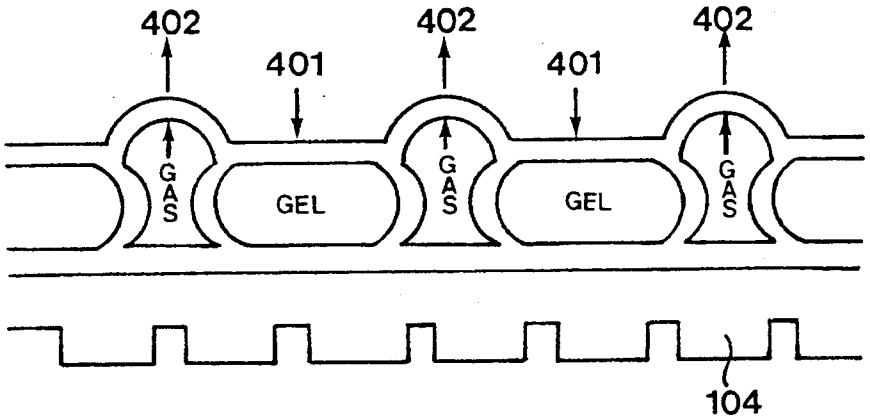

FIGS. 3–5 show the operation of the sole and insert. In FIG. 3, each of the cells 109 of the insert have their normal shape indicating the state of the sole and insert prior to any use. In FIGS. 4 and 5, the insert cells are subjected to compressive forces 401 exerted by the user. These forces cause the gel-filled cells to be compressed in the vertical direction and expand laterally as evidenced by the outward flexing of the side walls of these cells. This motion, in turn, causes compression of the gas-filled cells in the lateral direction and an expansion of these cells upwardly against the wearer's foot. This upward expansion creates force 402 which imparts what will be referred to as a "lift" sensation against the wearer's foot.

Figure 6:
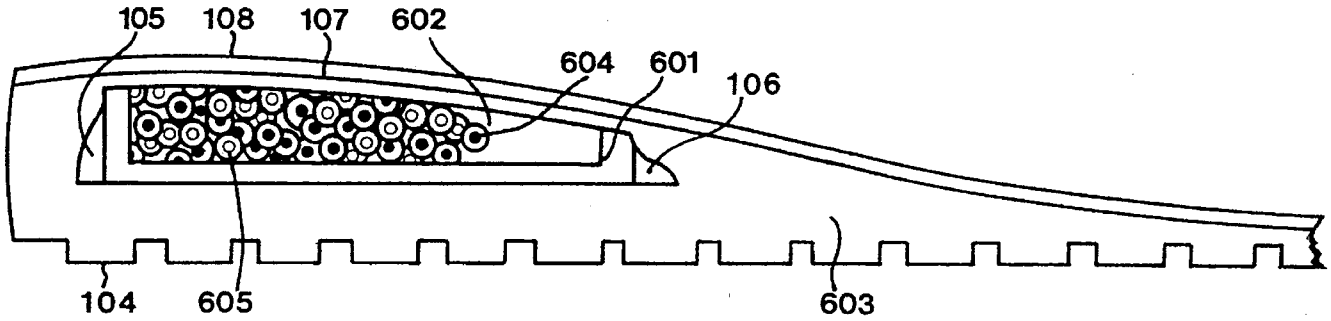
FIGS. 6 and 7, respectively, are elevation and bottom views of a shoe sole and insert pursuant to a second embodiment of the present invention.
Figure 7:
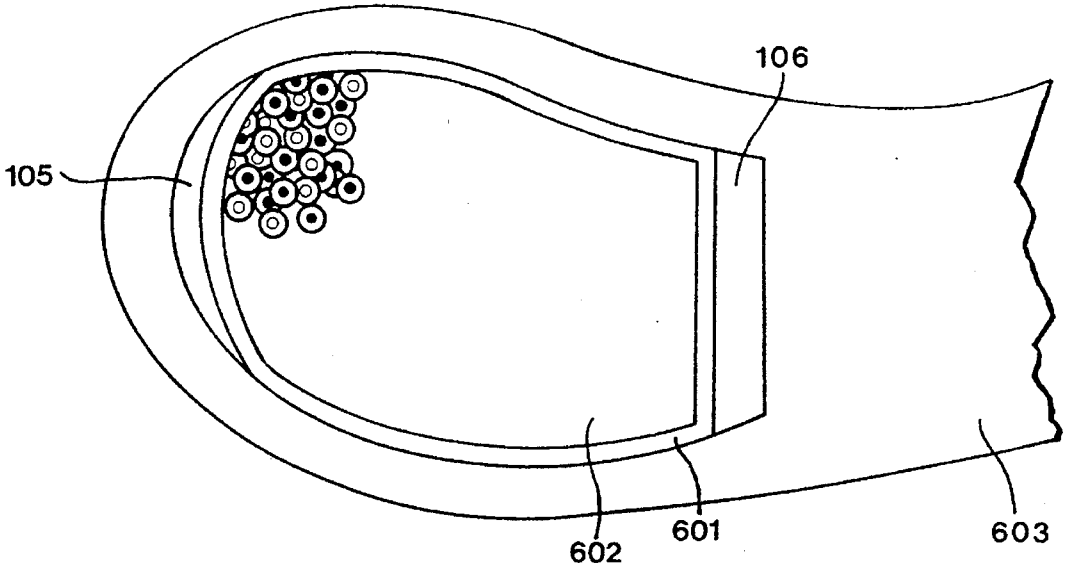

FIGS. 6 and 7 show a second embodiment of the present invention wherein the intersecting ribs of the first embodiment have been eliminated so that the insert 601 includes a single cavity 602. The balance of insert 601 and sole 603 incorporates the structure and all of the other features of their respective counterparts in the first embodiment discussed hereinabove. Pursuant to the second embodiment of the present invention, cavity 601 is completely filled with gas-filled pellets 604 and gel-filled pellets 605. Each pellet, whether gas or gel-filled, is made of a flexible material. The impact response of the sole and insert combination can be altered by varying the ratio of gas to gel-filled pellets so that high, medium and low pressure inserts can be supplied wherein the pressure of any insert is a function of the ratio of gas to gel-filled pellets. As with the first embodiment, an insert can be removed, replaced or reinserted and secured in position in the sole cavity using the technique described above.

Figure 9:
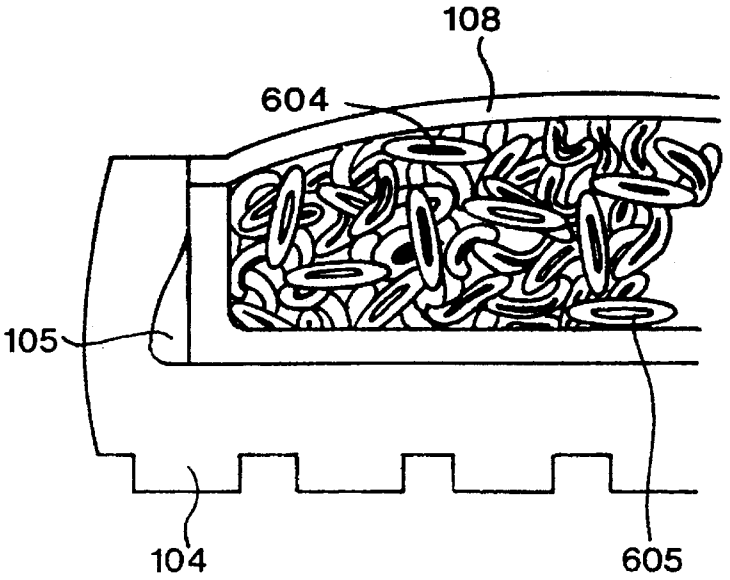
FIGS. 8 and 9 are elevation views of an arbitrary portion of the sole and sole insert of FIGS. 6 and 7 which shows the impact response of this sole and insert prior to and during use.
Figure 8:
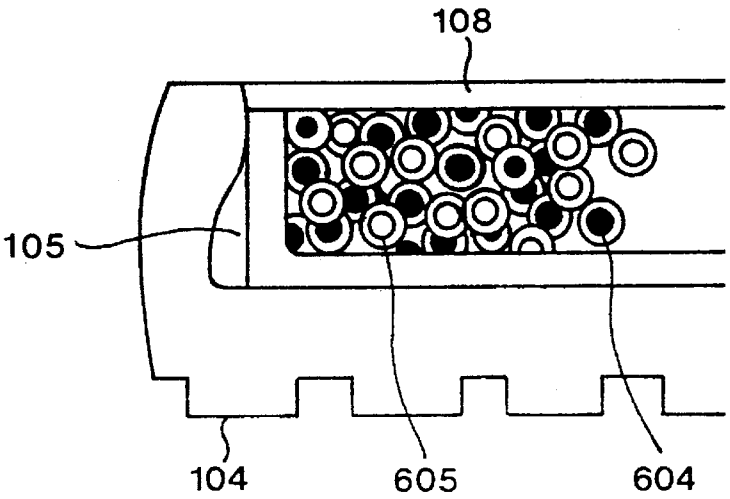

FIGS. 8 and 9 depict the operation of the sole and insert. In FIG. 8 the gas and gel-filled pellets are shown in an unstressed state, i.e., no compressive forces are being exerted by the wearer and the pellets are substantially undisturbed. In FIG. 9, however, when subjected to impact forces by the wearer, the pellets are disturbed and the compressive forces deform both the gas and gel-filled pellets with the former creating a "lift" sensation against the bottom of the shoe wearer's foot.

Figure 10:
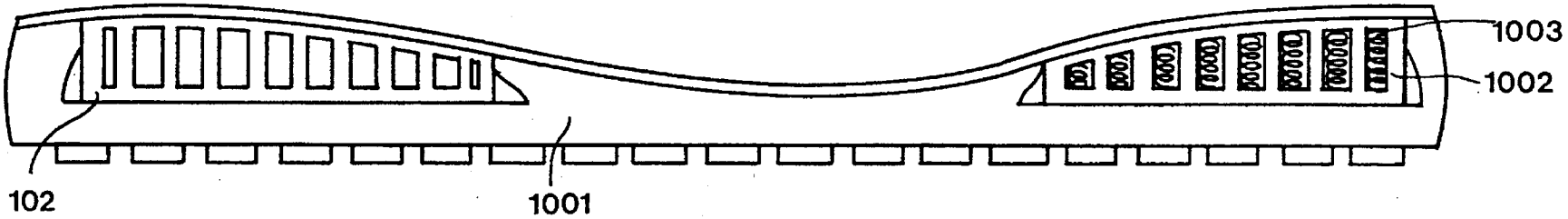
FIGS. 10 and 11 are elevation views of a sole incorporating inserts in both the heel and toe portions in accordance with third and fourth embodiments of the present invention, respectively.
Figure 11:
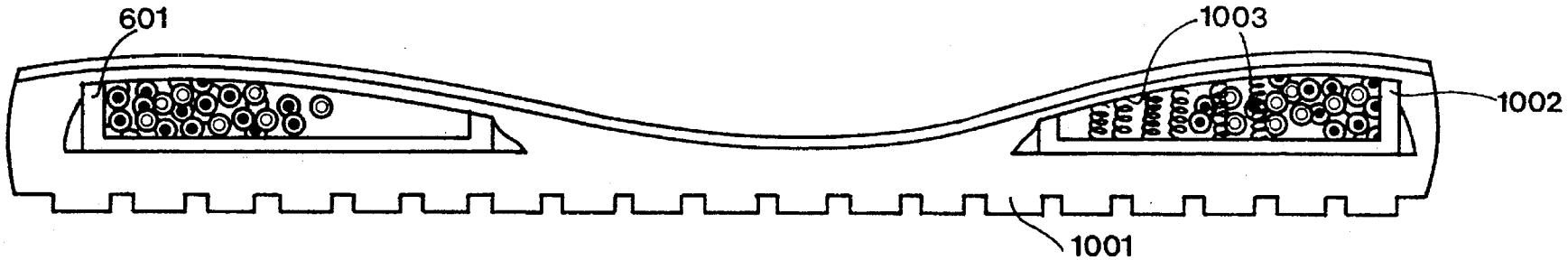

It is frequently desirable to combine the above-described gas-gel inserts with a second insert as shown in FIGS. 10 and 11. As shown in FIG. 10, insert 102 disposed in the heel portion of sole 1001 is combined with a second insert 1002 disposed in the toe portion of sole 1001. While insert 1002 can be fabricated to incorporate any of the above-described gas-gel structures, it is oftentimes desirable to utilize a different insert structure in the toe. Such an insert structure can incorporate one or more springs 1003 which are embedded within the insert. Such springs are arranged so as to impart a lift force against the ball of the wearer's foot upon impact with the ground. A variety of impact responses can be provided by varying the spring design and/or number of springs. While second insert 1002 can be designed so as to be a permanent part of the sole, if desired, the second insert can be designed with the same protuberances used in insert 102 to enable the second insert to be removed when worn out or when replacement with an insert with a different impact response is desired. FIG. 11 shows an arrangement similar to FIG. 10 wherein insert 601, disposed in the heel portion of the sole is combined with second insert 1002 disposed in the toe portion of the sole. The arrangement of FIG. 11 can incorporate any of the aspects of the present invention described in reference to FIG. 10.

With any of the above-described inserts it should be appreciated that all foot pressures are distributed over rather large areas and, therefore, will provide wearer comfort and will lessen the likelihood of injury to the heel and ball of the foot.

While the present invention has been disclosed in reference to the disclosed embodiments, other arrangements will be apparent to those of ordinary skill in the art and are to be considered within the spirit and scope of the present invention. For example, while the intersecting ribs in the drawings are depicted as rectilinear, they may also be formed to intersect so as to form a honeycomb, capsular structure, etc. Likewise, while the second insert incorporates springs, it may alternatively incorporate a honeycomb or capsular gas-gel structure. Moreover, the gas-gel structure used in the toe may be identical or different from that used in the heel. Finally, any insert can be designed so as to extend under the entire bottom of the wearer's foot. In summary, the subject invention is to be limited only by the claims which follow and their equivalents.

What is claimed is:

1. An article of footwear comprising:

(a) a sole having at least one cavity formed therein:

(b) at least one sole insert, each sole insert being disposed within a cavity formed in the sole, the sole insert including a plurality of sealed first cells and a plurality of sealed second cells, each of said first and second cells being arranged in a side-by-side adjacent relationship to each other and cooperating with each other, each first cell having an upper, a lower and a side wall and being filled with a gel material having a penetration value greater than 250 and each second cell having an upper, a lower and a side wall and being filled with a gas, the upper, lower and side walls of said first and second cells being constructed and arranged such that a downward force on the upper wall of a first cell causes the gel contained therein to bow the side wall of the first cell outwardly which in turn bows the side wall of an adjacent second cell inwardly to cause the gas contained therein to bow the upper wall of said second cell upwardly and wherein the first and second cells are separated by a plurality of intersecting members which are attached to a support structure defining the perimeter of the sole insert, and wherein the insert further comprises means for locking the insert in position within the sole cavity, the locking means also being unlockable so that the sole insert can be removed after being locked into the sole cavity, and wherein the locking means includes first and second protuberances which extend outwardly from the sole insert, and wherein the locking means includes the first and second recesses which extend outwardly from a sole cavity and the first and second protuberances, respectively, engage with the first and second recesses.

* * * * *